US005630260A

United States Patent [19]

Morita et al.

[11] Patent Number: 5,630,260

[45] Date of Patent: May 20, 1997

[54] METHOD AND APPARATUS FOR DISCHARGING FABRIC FROM CLOTH SPREADING MACHINE

[75] Inventors: Toshiaki Morita, Kaiso-gun; Akihiro Otani, Wakayama, both of Japan

[73] Assignee: Shima Seiki Manufacturing Limited, Wakayama, Japan

[21] Appl. No.: 377,974

[22] Filed: Jan. 25, 1995

[30] Foreign Application Priority Data

Jan. 27, 1994 [JP] Japan ..... 6-007810

[51] Int. Cl.[6] ..... A41H 43/02

[52] U.S. Cl. ..... 26/99; 38/144; 38/7; 112/DIG. 2; 83/937

[58] Field of Search ..... 26/99; 38/144, 38/7, 14, 56; 112/DIG. 2; 83/402, 98, 937; 271/97, 195

[56] References Cited

U.S. PATENT DOCUMENTS

| | | | |
|---|---|---|---|
| 4,514,246 | 4/1985 | Forrer et al. | 156/264 |
| 4,527,346 | 7/1985 | Schwartzott . | |
| 4,542,842 | 9/1985 | Reba | 83/98 |
| 4,544,824 | 10/1985 | Knutsson | 83/98 |
| 4,700,598 | 10/1987 | Gerber | 83/937 |
| 4,702,664 | 10/1987 | Lukens, Jr. | 271/195 |
| 4,747,329 | 5/1988 | Lukens, Jr. | 83/29 |

OTHER PUBLICATIONS

European Patent Office Communication dated Jul. 6, 1995 with Search Report for Application EP 95 10 1078.

*Primary Examiner*—Andy Falik
*Attorney, Agent, or Firm*—Baker & Botts, L.L.P.

[57] ABSTRACT

A running carriage (33) delivers, spreads, and piles a sheet material to be spread to form a piled sheet material (24), while running on a spreading table (22) of a cloth spreading machine (21). The piled sheet material (24) is placed on an underlay sheet (25) which has a larger area than that of the piled sheet material (24). At the bottom of the running carriage (33), a foot presser (27) is provided. The foot presser (27) is designed to be vertically displaced by a cylinder (28). A blower motor (29) drives a fan (30) to blow air through nozzles (31) towards the surface of the spreading table (22), thereby reducing the load of the piled sheet material (24). The underlay sheet (25) is pressed by the foot presser (27) and the running carriage (33) starts running, whereby the piled sheet material (24) is delivered.

13 Claims, 9 Drawing Sheets

METHOD AND APPARATUS FOR DISCHARGING FABRIC FROM CLOTH SPREADING MACHINE

FIELD OF THE INVENTION

The present invention relates to a method and an apparatus for moving piled fabric from a cloth spreading machine where fabric to be cut is piled while being spread to a spreading table.

BACKGROUND OF THE INVENTION

Conventionally, when a sheet-form fabric such as textile cloth is cut, the fabric is spread by using a cloth spreading machine prior to cutting, in order to make preparations for easily conducting a marking operation for pattern layout. The piled fabric is, in general, discharged manually by a worker or workers from the spreading table of the cloth spreading machine and transported to an automatic cutting machine or the like. In order to easily conduct the discharge operation, the cloth spreading machine is provided with a mechanism such that an air jet is directed from the surface of the spreading table to float the fabric, or with rollers on the surface of the spreading table.

In the cutting machine, the piled fabric is placed on the cutting table and cut into desired patterns. The cutting table generally has a surface driven as a conveyor for receiving the piled fabric and discharging the parts cut from the fabric.

FIG. 10 shows a configuration in which a prior art system capable of being driven as a conveyor is also employed in the cloth spreading machine in order to automatically transfer the piled fabric from the cloth spreading machine to the cutting machine. That is, spreading table 2 of the cloth spreading machine is designed to have a surface as a conveyor 3. The piled fabric, which has been spread and piled on a spreading table 2 when conveyor 3 was stopped, is transferred onto cutting table 5 of cutting machine 4 by driving conveyor 3. Driving conveyor 3 of spreading table 2 in synchronism with conveyor 6 of cutting table 5, makes it possible to automatically transfer the piled fabric onto cutting table 5.

FIG. 11 schematically shows the configuration of the prior art disclosed in Japanese Examined Patent Publication JP(B2) 62-25785 (1987). This prior art is functional to spread a fabric roll 7 and a fabric covering sheet roll 8 of an air-impermeable plastic sheet material on cutting table 5. This function is achieved by a sheet pinching device 11 attached to a label carriage 10 installed separately from the cutting carriage equipped with a cutting tool. The label carriage 10 travels across the surface of cutting table 5 and applies a label for identifying each part to be cut. Using this traveling function, the sheet material is pulled out held by sheet pinching device 11 from fabric roll 7 to be spread on cutting table 5. Automatically controlling label carriage 10 and sheet pinching device 11 enables the automatic discharge of the fabric onto cutting table 5.

When the piled fabric is discharged manually, it is necessary for workers to hold both widthwise ends of the fabric to prevent the fabric from being wrinkled. At least two workers are required for conducting the operation. As shown in FIG. 10, employing spreading table 2 driven as a conveyor increases the manufacturing cost of cloth spreading machine 1. On the other hand, like the prior art shown in FIG. 11, in the case where no cloth spreading machine is installed, the operations of pulling out the fabric from the fabric roll and spreading the pulled-out fabric are carried out in cutting machine 4. Cutting is unable to be carried out during the operation of pulling-out the fabric, which results in lowering the activity rate of cutting machine 4.

In general, because cutting machine 4 cuts parts from the fabric with cutting carriage 9 while cutting table 5 generates a vacuum, the length of cutting table 5 may be limited. Accordingly, for the purpose of satisfying various needs, it is rather convenient to provide cloth spreading machine 1 beside cutting machine 4, and to make the length of spreading table 2 greater than that of cutting table 5 so that a fabric that is longer than cutting table 5 may be spread. With this design, in cases where the fabric is cut into pieces that are longer than cutting table 5, an advanced method and system may be also employed. The fabric is repeatedly cut at each cutting operation in such a manner that when cutting of one portion has been completed, the next portion is moved to the cutting table position. Unlike the prior art, the advance method and system is adopted only to each portion of fabric which is pulled out continuously from fabric roll 7 to be processed. Therefore, the efficiency of cutting operation is not so high.

SUMMARY OF THE INVENTION

It is an object of the invention to provide a fabric discharging method and an apparatus for discharging a fabric from a cloth spreading machine, having a simple construction and capable of automatically discharging the fabric piled in layers.

The invention provides a method for discharging a fabric from a cloth spreading machine, in which the fabric is delivered from a running carriage loaded with a fabric roll at a predetermined length onto a spreading table of the cloth spreading machine and piled in layers. The method includes moving the running carriage to a predetermined catching position in relation to the piled fabric, catching the piled fabric with a catching device, and blowing air toward the bottom surface of the fabric piled in layers from the surface of the spreading table. The method further includes discharging the piled fabric from the spreading table by running the running carriage while the piled fabric is held by the catching device.

BRIEF DESCRIPTION OF THE DRAWINGS

Other and further objects, features, and advantages of the invention will be more explicit from the following detailed description taken with reference to the drawings wherein.

DETAILED DESCRIPTION OF THE INVENTION

Figure 1A:
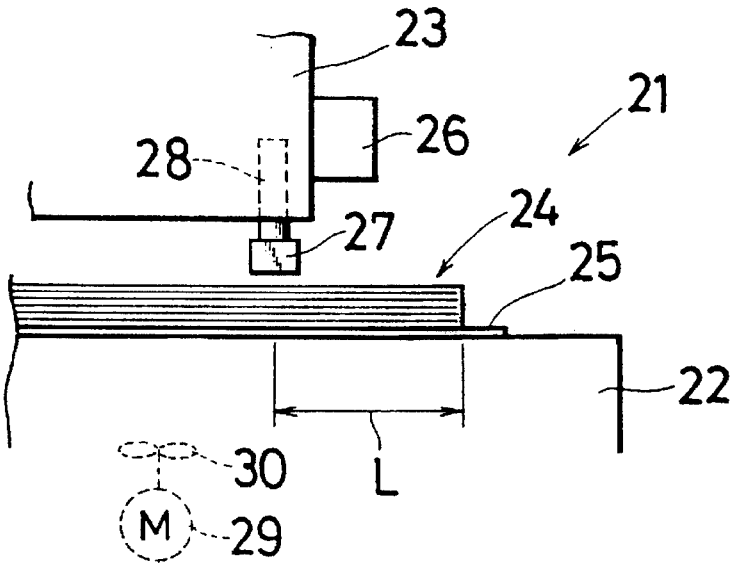
FIG. 1A is a schematic front elevation view of one embodiment according to the invention.

Now referring to the drawings, preferred embodiments of the invention are described below.

Figure 1B:
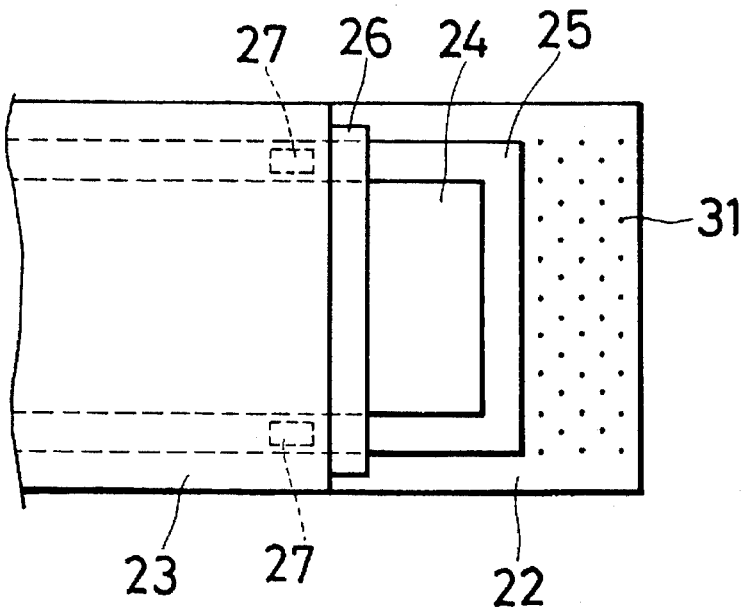
FIG. 1B is a schematic plan view of one embodiment according to the invention.

FIG. 1 schematically shows a construction of one embodiment according to the invention. FIGS. 1A and 1B show a front view and a plan view, respectively, of the present invention. While traveling on a spreading table 22 of a cloth spreading machine 21 in the horizontal direction of FIG. 1, a carriage 23 delivers and piles laminations of fabric sheet material to be spread in order to form a piled sheet material 24. Piled sheet material 24 is arranged on an underlay sheet 25 having a larger area than piled sheet material 24. For underlay sheet 25, for example, craft paper having pores at specified intervals is used. Underlay sheet 25 is typically used to prevent the bristles of bristle brushes which form the cutting table surface from piercing the spread fabric when the fabric is cut by the automatic cutting machine.

The steps of spreading and piling the fabric are repeated until the thickness of piled sheet material 24 has become relatively large. A lifter 26 then raises and adjusts the height of the sheet material delivered from a carriage 23 to the height of the top layer of piled sheet material 24.

In the lower portion of carriage 23, a foot presser 27 comprises a pressing device. Foot presser 27 is displaceable in the vertical direction by a cylinder 28. Foot presser 27 and cylinder 28 comprise a catching device, which catches piled sheet material 24 at the position length L distant from the head end of piled sheet material 24. In spreading table 22, an air compressor comprising blower motor 29 and a fan 30 is provided. In the surface of spreading table 22, nozzles 31 are provided at specified intervals. Rotating a blower motor 29 causes air compressed by fan 30 to be blown from nozzles 31 to the surface of spreading table 22. Thereby, underlay sheet 25 floats on a layer of air and the frictional resistance between the bottom surface of underlay sheet 25 and the surface of spreading table 22 is reduced, with a result that easy transportation can be realized.

Figure 2:
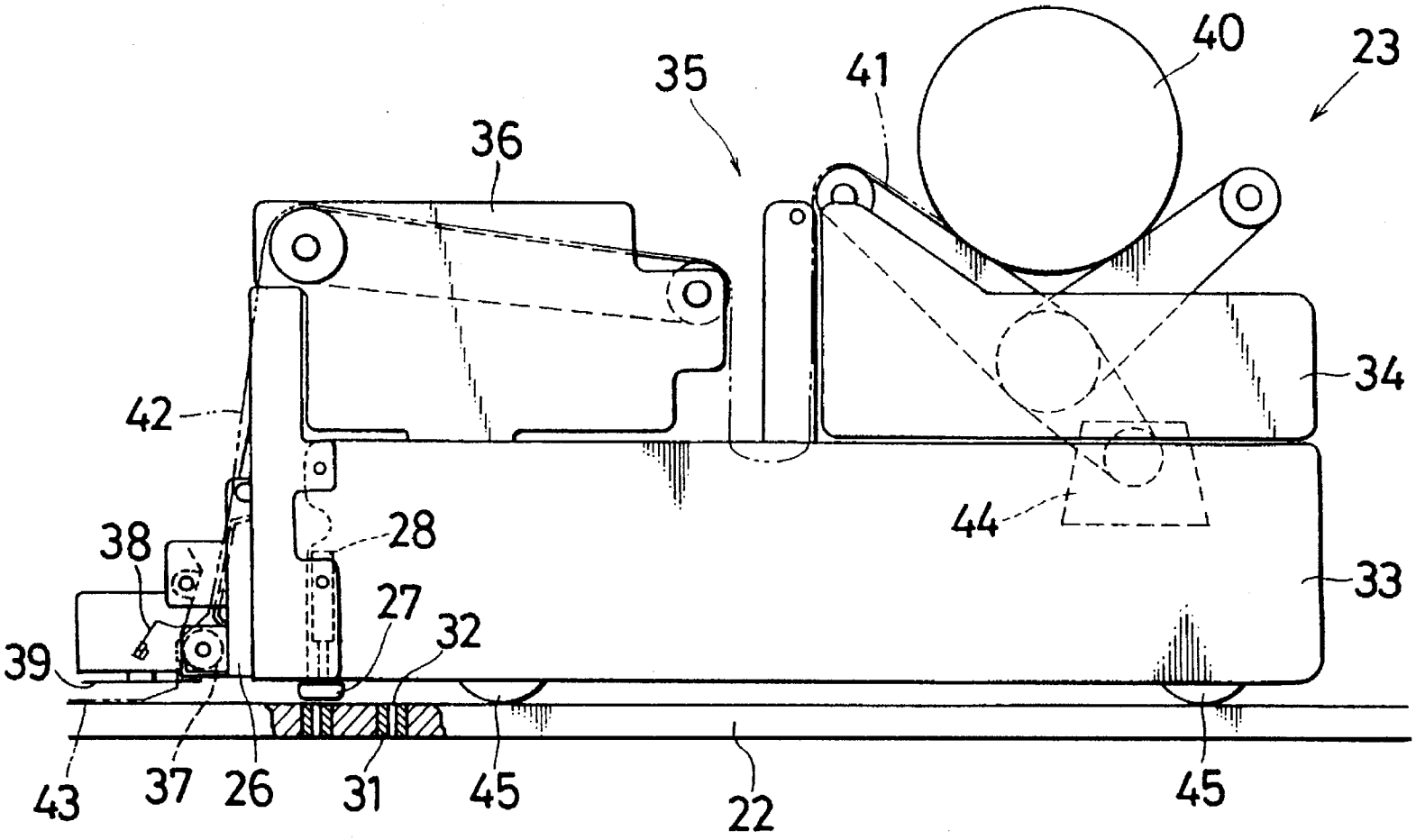
FIG. 2 is a front view partly broken away to show a construction related to a spreading table and carriage according to the invention.

FIG. 2 is a front view partly broken away to show a construction related to spreading table 22 and carriage 23. An exhaust hole 32 for blown air is provided in nozzle 31. Carriage 23 is provided with a running carriage 33, a sheet roll unrolling portion 34, a sheet releasing portion 35, and a sheet delivering portion 36. In the front end surface of carriage 23 in the running direction, a fabric spreading roller 37, a fabric retainer 38, and a cutter 39 are provided and are vertically displaceable by lifter 26. A foot presser 27 and a cylinder 28 for vertically displacing foot presser 27 are provided right behind lifter 26.

A fabric sheet roll 40, in which the fabric sheet material to be spread is wound, is placed on belts intersecting each other in a V letter shape. Fabric sheet material 41 is pulled out from fabric sheet roll 40 at sheet roll unrolling portion 34, and delivered as a fabric sheet material 42 through sheet releasing portion 35 and sheet delivering portion 36 to the front end surface of carriage 23, from which fabric sheet material 42 is hung. Subsequently fabric sheet material 42 is spread by spreading roller 37 and pulled out as a fabric sheet material 43 on spreading table 22. Fabric sheet material 41 is delivered from fabric sheet roll 40 while the fabric sheet roll 40 is rotated on the intersecting belt by a fabric sheet roll unrolling motor 44. Movement of carriage 23 is smoothly conducted with wheels 45.

Figure 3A:
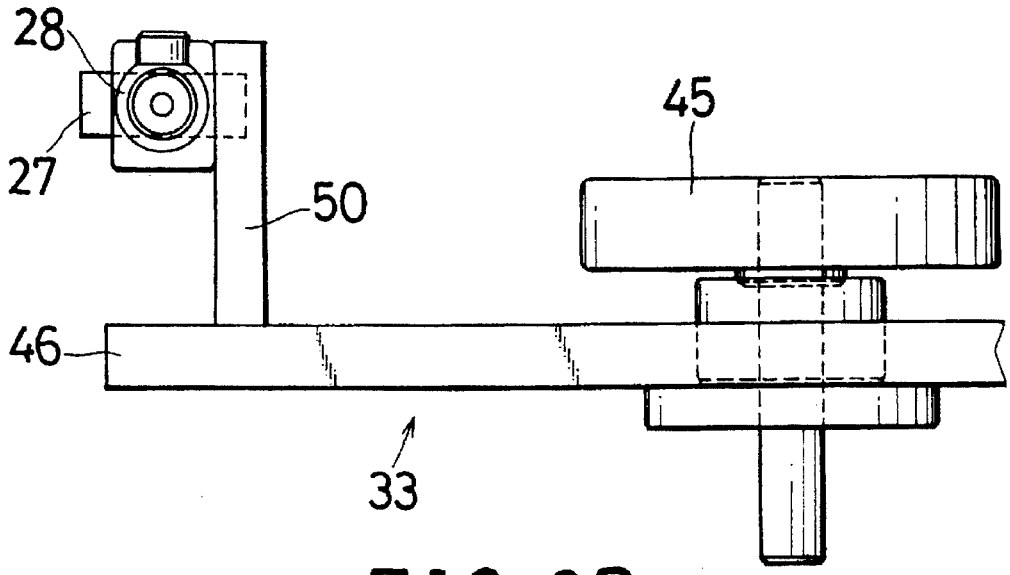
FIG. 3A is a schematic plan view to show a construction related to a foot presser of FIG. 1.
Figure 3B:
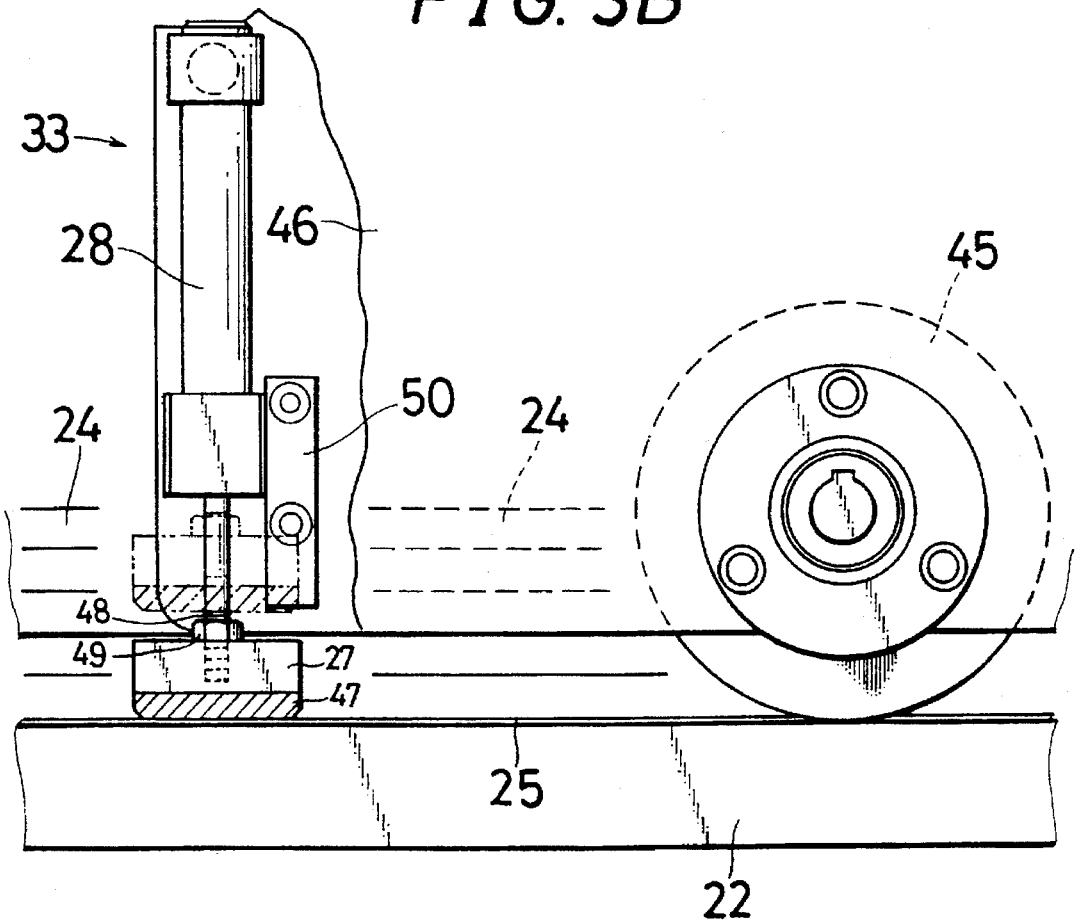
FIG. 3B is a front view partly broken away to show a construction related to the foot presser of FIG. 1.
Figure 4:
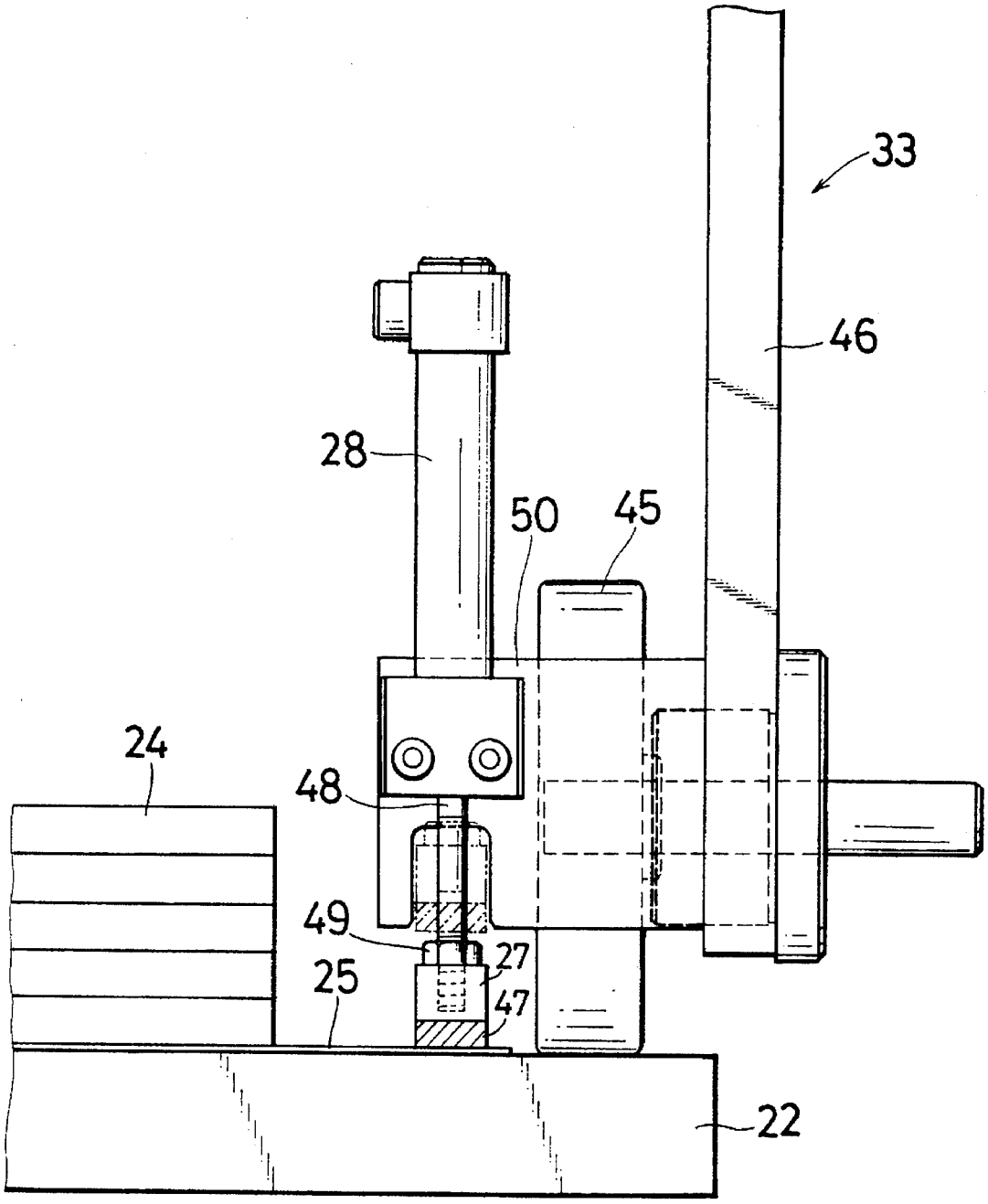
FIG. 4 is a side view as seen from the front side of the transporting direction to show a construction related to the foot presser of FIG. 1.

FIGS. 3 and 4 show enlarged views of the construction of foot presser 27. FIGS. 3A and 3B are a plan view and a partly broken plan view, respectively, and FIG. 4 shows a left side view of FIG. 3B. In these FIGURES, a cylinder 28 equipped with foot presser 27 is installed ahead of side plate 46 of running carriage 33. On the lower end surface of foot presser 27, rubber sheet 47 such as urethane rubber is affixed. Foot presser 27 is fixed to the head end of a rod 48 of cylinder 28 by the use of a nut 49. When cylinder 28 is extended, for example, by air pressure, rubber sheet 47 of the surface of foot presser 27 compresses underlay sheet 25 between rubber sheet 47 and the surface of spreading table 22 and catches piled sheet material 24 via underlay sheet 25. Cylinder 28 is mounted on side plate 46 via a fixing plate 50. Contracting rod 48 of cylinder 28 raises foot presser 27 up to the position shown by the two dot chain line, releasing the condition in which underlay sheet 25 is not compressed.

Figure 5:
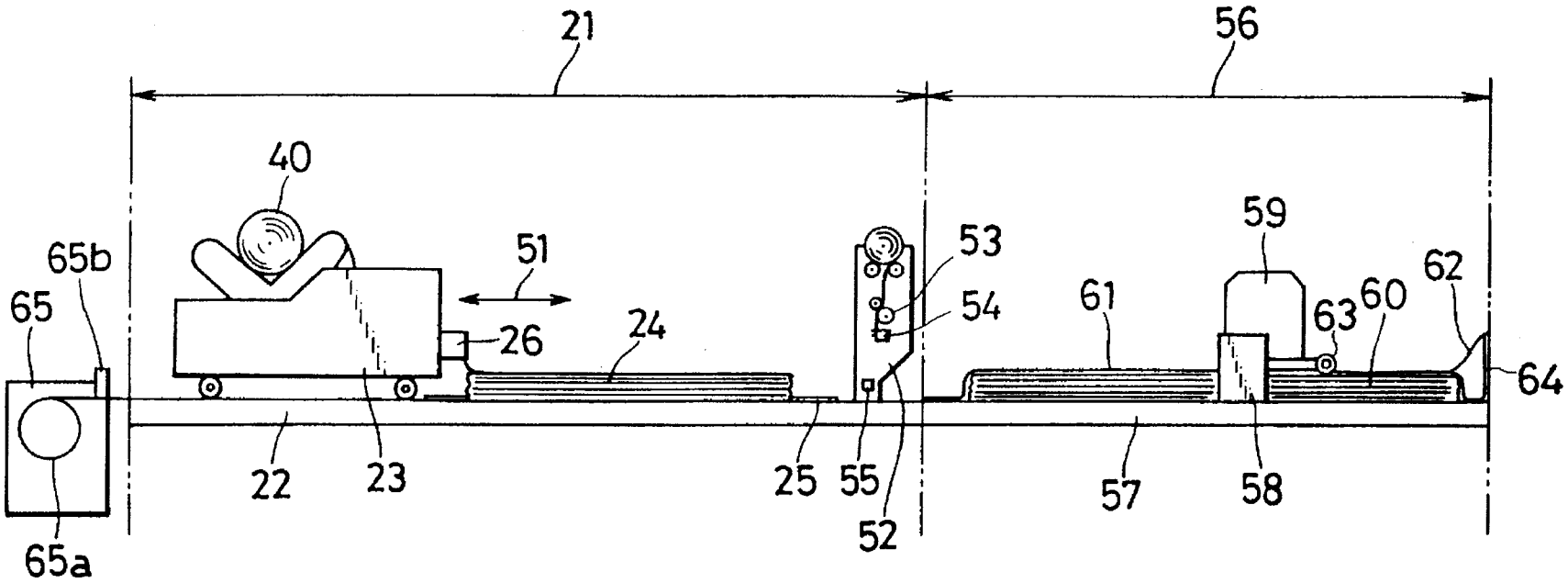
FIG. 5 is a schematic front view of a system comprising a cloth spreading machine and an automatic cutting machine in the embodiment of FIG. 1.

FIG. 5 shows a system in which cloth spreading machine 21 and cutting machine 56 are arranged in succession, such that the fabric is processed from left to right. Cloth spreading machine 21 piles the fabric while carriage 23 is reciprocatingly running and moving in the spreading direction 51, and forms piled sheet material 24 on underlay sheet 25. On the downstream end of cloth spreading machine 21, a sheet covering apparatus 52 is provided. The sheet covering apparatus 52 has a delivery apparatus 53, a cutting machine 54, and a fabric sensor 55.

On the downstream side of cloth spreading machine 21, automatic cutting machine 56 is provided. On a cutting table 57 of automatic cutting machine 56, cutting carriage 58 is provided. Cutting carriage 58 is movable in the horizontal direction of FIG. 5 on cutting table 57. A cutting head 59 for cutting the fabric is provided for cutting carriage 58. Cutting table 57 is constructed as a conveyor with a bristle mat on its surface. Piled sheet material 60 is cut from the downstream side by cutting head 59 in accordance with predetermined cutting data prepared by a computer design system or other suitable method or device. The surface of piled sheet material 60 is covered with air-impermeable covering sheet 61. Air-impermeable covering sheet 61 is an air-impermeable synthetic resin sheet such as polyethylene delivered from sheet covering apparatus 52. Since air-impermeable covering sheet 61 is cut by cutting head 59 simultaneously with piled sheet material 60, the air impermeability is lost. To maintain air impermeability, air-impermeable covering sheet 62 from the downstream side of cloth spreading machine 21 is spread on piled sheet material 60 after cutting. Air-impermeable covering sheet 62 is spread between a fabric sheet roll 63 provided in cutting carriage 58 and a stand 64 provided at the front end of cutting table 57.

On the upstream side of cloth spreading machine 21, an underlay sheet feeder 65 is installed, which pulls out underlay sheet 25 onto spreading table 22 from an underlay sheet roll 65*a* to spread. Underlay sheet 25 is automatically spread by the use of catching means provided in carriage 23. The pulled out underlay sheet 25 can be cut by a cutter 65*b*.

Figure 6:
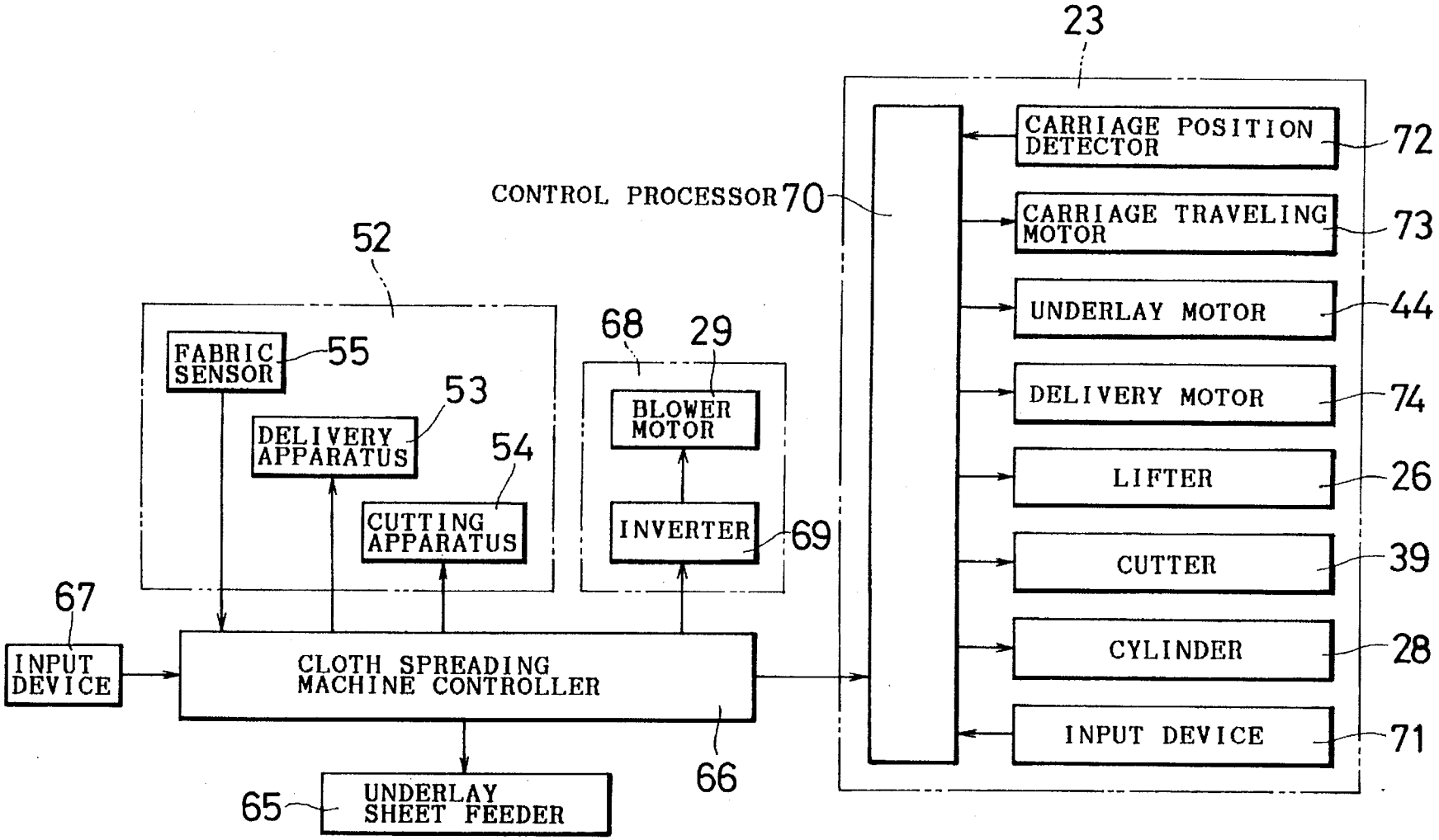
FIG. 6 is a block diagram showing an electrical configuration of the system of FIG. 5.

FIG. 6 shows an electrical control system block diagram for the system of FIG. 5. Spreading data and cutting data are entered from an input device 67 into a cloth spreading machine controller 66. Control data is also entered to synchronize cloth spreading machine 21 with the conveyor drive of the cutting table of the automatic cutting machine 56. The blown air from nozzles 31 of spreading table 22 is produced by an air compressing apparatus 68. Inside air compressing-apparatus 68, an inverter 69 is provided to control the rotating speed of blower motor 29 and to drive the motor in such a manner to continuously adjust the air pressure. Cloth spreading machine controller 66 controls inverter 69 in accordance with the conditions of the sheet material of fabric to be spread. For example, the thickness and weight of piled sheet material 24 may be provided as controls inputs to obtain appropriate air pressure. In addition, cloth spreading machine controller 66 responds to the signals from fabric sensor 55 in sheet covering apparatus 52, controls delivery apparatus 53 and cutting machine 54 to deliver an air-impermeable covering sheet 61 and cuts out a piece having a specified length therefrom.

A microcomputer is included in a central processor 70 in carriage 23 controlled by cloth spreading machine controller 66. The length of the fabric to be cut out, the number of cut out fabrics, and control data are input into input device 67 as spreading data. The control data specifies the control mode such as whether repeated discharge should be carried out, whether cutting should be done with the cut-out fabric as it is, or whether an advance mode is employed in which the cut-out fabric is cut plural times. Central processor 70 responds to the signals expressing the position of carriage 23 from a carriage position detector 72 and controls a carriage running motor 73, fabric sheet roll unrolling motor 44, delivery motor 74, lifter 26, cutter 39, and cylinder 28.

Figure 7:
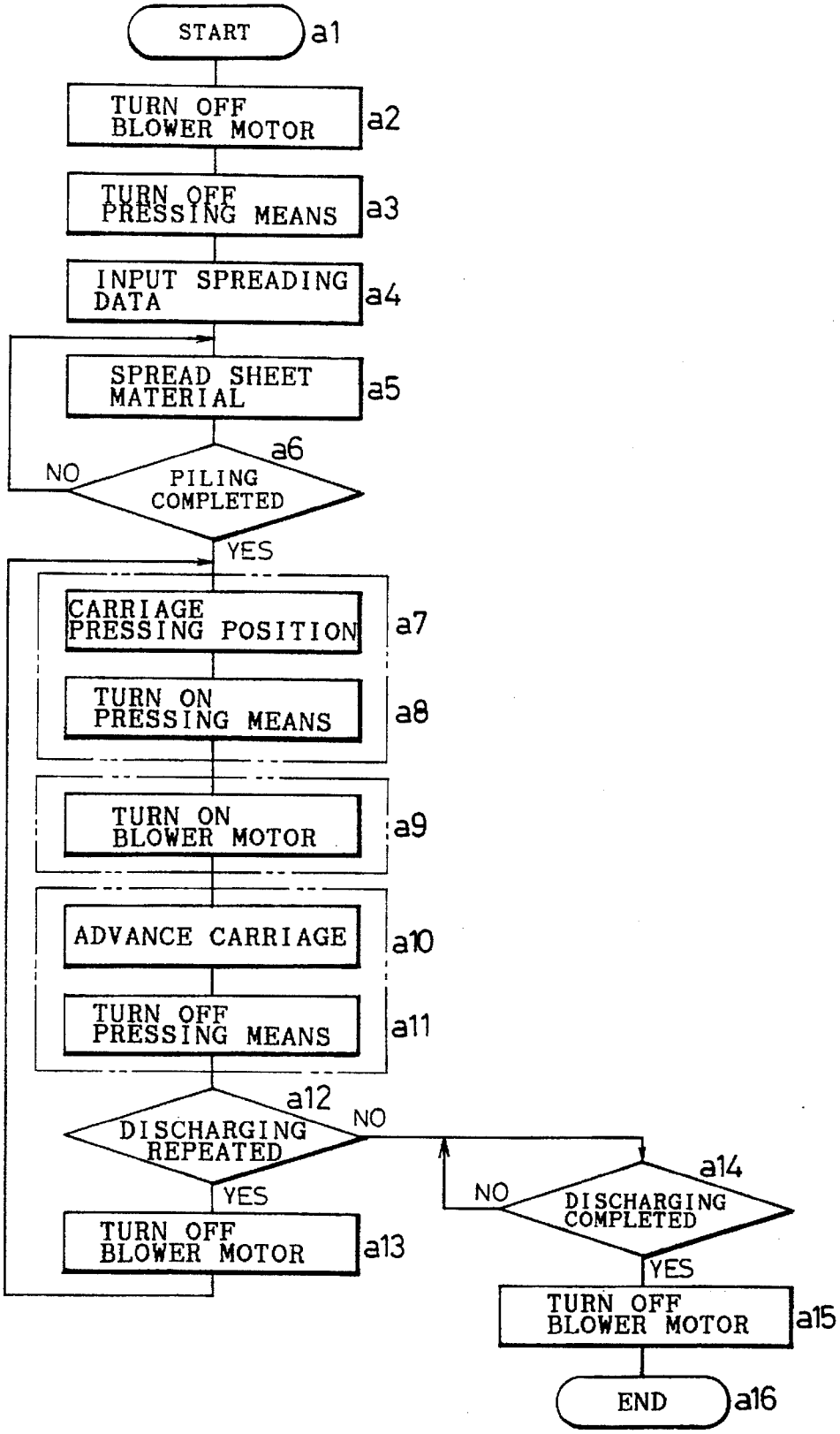
FIG. 7 shows a flow chart showing an operation of the system of FIG. 5.

FIG. 7 is a flow chart showing the operation of the configuration in FIG. 6. Operation begins from step a1, blower motor 29 is turned off at step a2, and at step a3 cylinder 28 is raised to turn off the compressing means. Subsequently, at step a4, the spreading data is entered from input device 71. At step a5, the sheet material is spread. At step a6, it is determined whether the specified number of sheets has been piled. If the specified number of sheets has not been piled, the operation returns to step a5.

Upon completion of spreading, at step a7, carriage 23 is moved up to the compressing position. At step a8, cylinder 28 is lowered and the compressing means is brought to the ON state. Then, at step a9, blower motor 29 is turned on and from the surface of spreading table 22, air is blown out. At step a10, carriage 23 is advanced to the running direction. When carriage 23 moves by a specified distance, at step a11, cylinder 28 is raised to turn off the compressing means. At step a12, it is determined whether repeated delivery mode is set or not. When the repeated delivery mode is set, at step a13, blower motor 29 is turned off and operation returns to step a7. When the repeated delivery is completed at step a12, or when no repeated delivery is carried out, operation moves to step a14 where it is determined whether delivery is completed or not. If the delivery is not completed, delivery is resumed. When the delivery is judged to be completed, at step a15, blower motor 29 is turned off and operation ends at step a16.

Among the above steps, steps a7 and a8 are catching step A1 in which piled sheet material 24 is caught. Step a9 is blowing step A2 in which air is blown toward the bottom surface of the caught fabric. Steps a10 and a11 are delivery step A3 in which the caught fabric is delivered ahead in the transporting direction. Each step automatically takes place, resulting in not only freedom from delivery operations carried out by a plurality of workers but also in freedom from generation of positional deviation which is unavoidable when a plurality of workers are working together. Consequently, if the system is designed to directly deliver the fabric to automatic cutting machine 56, the operation in which coordinates are adjusted for cutting can be simplified.

Figure 8A:
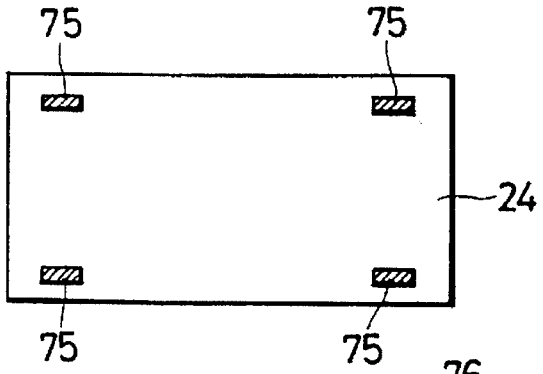
FIG. 8A is a schematic plan view to show the position at which a piled sheet material is caught in the embodiment of FIG. 1.
Figure 8B:
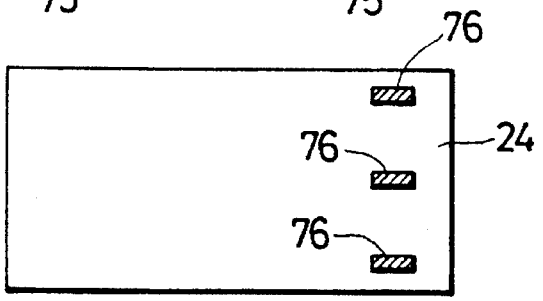
FIG. 8B is a schematic plan view to show the position at which the piled sheet material is caught in the embodiment of FIG. 1.
Figure 8C:
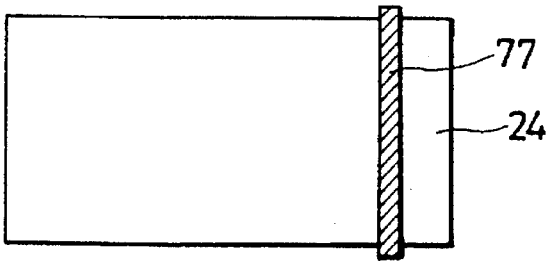
FIG. 8C is a schematic plan view to show the position at which the piled sheet material is caught in the embodiment of FIG. 1.

FIG. 8 shows an example of the position in which the piled sheet material 24 is compressed and caught by foot pressers 27. The number of catching positions may be two but FIG. 8A shows four catching positions 75, while FIG. 8B shows three catching positions 76 and FIG. 8C shows a widened catching place 77. It is preferable to provide a plurality of catching positions 75, 76 at places symmetrical to the width direction, which is shown as a vertical direction in the FIGURE. The widened catching place 77 may be one place. When underlay sheet 25 is not used, the top layer of piled sheet material 24 is directly pressed. The pressing force of cylinder 28 may be, for example, about 3 kgf. If vacuum suction is applied from the surface of foot presser 27, catching can be carried out with further reliability. When the surface of foot presser 27 is built in a-one-way clutch construction and the fabric is designed to be pulled from the downstream side, smooth delivery may be provided even when the conveyor speed of the downstream automatic cutting machine is higher than carriage 23 running speed. For example, the one-way clutch construction may include spring-loaded pawls designed to tilt toward the downstream side in the delivery direction. When the fabric is pulled to the downstream side, the pawls lie down, thus preventing operation, while when the fabric is pushed out, the pawls stand up, thus allowing operation.

Figure 9:
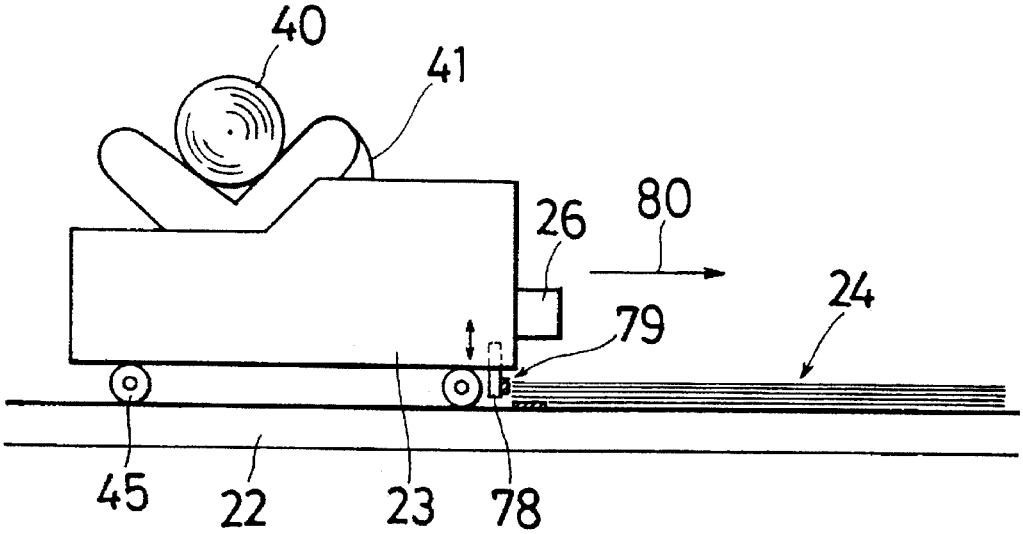
FIG. 9 is a schematic front view of another embodiment according to the invention.
Figure 10:
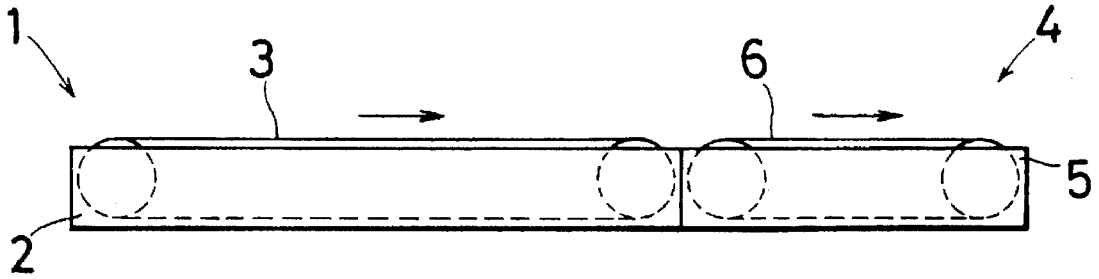
FIG. 10 PRIOR ART
FIG. 10 is a schematic front view to show a prior art method to deliver a fabric from a cloth spreading machine.
Figure 11:
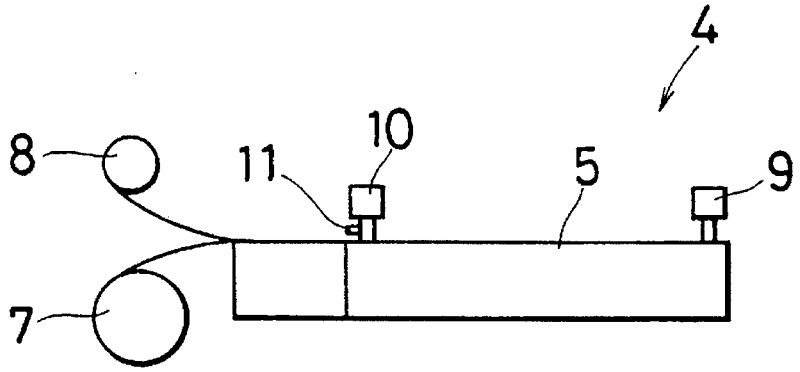
FIG. 11 PRIOR ART
FIG. 11 is a schematic front view to show a prior art method for carrying a fabric to a cutting machine.

FIG. 9 shows another embodiment of this invention. The embodiment resembles the embodiment of FIG. 1 and the same reference numerals are given to the corresponding portions.

What is noteworthy is that propelling means 78 which serves as catching means for piled sheet material 24 presses rear end surface 79 of piled sheet material 24 in a transport direction 80 for propelling. Because this is not designed to compress piled sheet material 24 from upside, piled sheet material 24 can be delivered without compression.

Underlay sheet 25 is spread on spreading table 22 by the use of catching means of carriage 23, but it may be designed to be spread manually. In front of cloth spreading machine 21 in the transport direction, automatic cutting machine 56 is provided, but a working bench on which piled sheet material 24 is temporarily placed may be installed. Even a simple working bench, which is not provided with any carry-in function, can efficiently transport piled sheet material 24 because the fabric is transported while being caught by the catching means.

In summary, the discharging step of the invention is characterized in that the piled sheet material 24 is discharged and carried onto cutting table 57 of automatic cutting machine 56 installed on the downstream side of the discharge direction. Automatic cutting machine 56 of the invention is characterized in that cutting table 57 is driven as a conveyor and the discharging step is characterized in that the movement of running carriage 33 which has held piled sheet material 24 is carried out in relation to driving of the conveyor.

The invention is characterized in that the steps of catching, blowing, and discharging are repeated every predetermined length of fabric with a step for releasing the piled sheet material 24. The fabric is delivered from running carriage 33 and piled in layers onto an underlay sheet pre-spread on spreading table 22. At the catching step the piled sheet material 24 is caught through underlay sheet 25. The uppermost layer of the piled sheet material 24 is covered with an air impermeable covering sheet 61 at the discharging step.

The present invention provides an apparatus for delivering a predetermined length of fabric onto spreading table 21 from running carriage 33 loaded with fabric sheet roll 40, for piling the fabric in layers and for discharging piled sheet material 24 from cloth spreading machine 21. The apparatus comprises means for catching installed in running carriage 33 and capable of changing over between an operative condition in which the piled fabric is caught and an inoperative condition in which the piled fabric is not caught. Means for compressing air is provided to blow air from the surface of spreading table 22 toward the bottom surface of a lowermost layer of piled sheet material 24. Controller 66 is also provided to control running carriage 33 to move to a predetermined catching position in relation to the fabric piled in layer so that the catching means of running carriage 33 catches the piled sheet material 24 and while air compressing means is operated in order to discharge the piled fabric from spreading table 22.

The invention is characterized in that the catching means comprises pressing means for pressing piled sheet material 24 from upside, and at least a part of piled sheet material 24 is caught between the pressing means and the surface of spreading table 22 under the pressing operative condition of the catching means. The pressing means of the invention is characterized by being installed in the front of running carriage 33 in relation to the discharging direction of piled sheet material 24.

The pressing means of the invention is characterized by pressing the uppermost layer of piled sheet material 24 from upside. Piled sheet material 24 is loaded on underlay sheet 25 having a width larger than that of piled sheet material 24 in relation to the conveying direction. The pressing means presses underlay sheet 25 in the outside of the width of the region where piled sheet material 24 is placed. The catching means includes propelling means for propelling piled sheet material 24 by pressing forward the rear end surface thereof in the discharge direction. The propelling means is in contact with the rear end surface of piled sheet material 24 under the propelling operation.

The invention is characterized in that the controlling means controls the running speed of running carriage 33 to discharge piled sheet material 24 in relation to the downstream side of the discharge direction. Running carriage 33 delivers a fabric onto spreading table 22 by a predetermined length, and is provided with catching means for catching and moving piled sheet material 24. When the fabric has been delivered onto cloth spreading machine 21, running carriage 33 is allowed to run and move to the predetermined catching position and piled sheet material 24 is caught with the catching means. When air is blown toward the bottom surface of the lowermost layer of piled sheet material 24 from spreading table 22, the frictional resistance between the lowermost layer of piled sheet material 24 and spreading table 22 is reduced. Therefore, when running carriage 33 starts running, piled sheet material 24 is able to be easily discharged.

According to the invention, piled sheet material 24 discharged from spreading table 22 is carried onto cutting table 57 of automatic cutting machine 56. Piled sheet material 24 is automatically transferred from cloth spreading machine 21 to the downstream side of the discharge direction, and can be automatically cut with automatic cutting machine 56. Since cutting table 57 of automatic cutting machine 56 is driven as a conveyor and running carriage 33 which has caught piled sheet material 24 is moved and travels in relation to driving of the conveyor, piled sheet material 24 is able to be smoothly transferred from cloth spreading machine 21 to automatic cutting machine 56.

It is possible to repeat each of the steps of catching, blowing, discharging, and releasing piled sheet material 24 from being caught for the predetermined length of fabric in relation between the movement of running carriage 33 and driving of cutting table 57 as a conveyor. In case of soft fabrics or an extremely small number of layers of piled sheet material 24, the length from the conveyor on the automatic cutting side to the catching position is limited and if excessively long, piled sheet material 24 may be loosened or folded in discharging. When a repeating method is adopted in which piled sheet material 24 is caught by predetermined length to prevent loosening or folding, such soft fabrics are able to be securely discharged with the catching means and the conveyor.

According to the invention, since the fabric is piled in layers on underlay sheet 25 pre-spread on spreading table 22 and piled sheet material 24 is caught via underlay sheet 25, it is not necessary to directly catch piled sheet material 24 and there is no fear for the collapse of piled sheet material 24. When the fabric to be piled in layers is porous or soft and a bristle mat is overlaid on the surface of the conveyor, underlay sheet 25 is used for the purpose of preventing bristles from piercing piled sheet material 24. Such underlay sheet is also effectively used in discharging piled sheet material 24.

According to the invention, at the discharging step, air-impermeable covering sheet 61 is covered over the uppermost layer of piled sheet material 24. Since piled sheet material 24 is held by vacuum suction during the cutting operation of automatic cutting machine 56, it is necessary to cover piled sheet material 24 with air-impermeable covering sheet 61 when the permeability of the fabric is large. Air-impermeable covering sheet 61 may be overlaid at the stage when the fabric is discharged from cloth spreading machine 21 to automatic cutting machine 56, and as a result the loads on the cutting machine side can be alleviated.

Controller 66 operates the air compressing means while catching piled sheet material 24 sheets with the catching means. Piled sheet material 24 is discharged by running carriage 33 with decreased frictional resistance to spreading table 22 surface. Since a technique to blow air to piled sheet material 24 with air compressing means has been adopted, it is possible to automatically discharge the fabric such that only catching means is added to running carriage 33. The catching means presses piled sheet material 24 from upside and catches at least a part of piled sheet material 24 between the catching means and spreading table 22 surface. Since this configuration needs pressing from only one direction, the catching means can be achieved by a simplified configuration as compared to the configuration required for pinching the fabric.

The pressing means is installed in the front of running carriage 33 in the discharging direction. Since the pressing means is installed near the foremost end of running carriage 33 in the discharging direction, even a short fabric can be discharged and as a result moving of running carriage 33 can be effectively used to discharge piled sheet material 24. The pressing means presses the uppermost layer of piled sheet material 24 from upside. Since air pressure is exerted on the bottom surface of piled sheet material 24 from spreading table 22, piled sheet material 24 can be sufficiently caught even if the pressing force from upside would not normally be sufficient to overcome frictional forces.

According to the invention, piled sheet material 24 is placed on underlay sheet 25 having a larger width than that of the piled fabric with respect to the transporting direction. The pressing means presses a portion of underlay sheet 25 which is the widthwise outside of the area where the piled fabric is placed. Thus piled sheet material 24 is not directly pressed, and as a result it is possible to exert pressing force large enough to grasp the fabric to securely catch and discharge piled sheet material 24. The propelling means included in the catching means comes in contact with the rear end surface in the discharging direction of piled sheet material 24 to press piled sheet material 24 and propels piled sheet material 24 forwards. Piled sheet material 24 is not pressed from both sides, and therefore piled sheet material 24 is able to be discharged without being compressed from upside or without using any underlay sheet.

Since the discharge speed of piled sheet material 24 is controlled with cloth spreading machine 21, it is easy to discharge piled sheet material 24 at a speed nearly equal to or lower than the conveying speed of automatic cutting machine 56. As described above, according to the invention, piled sheet material 24 is able to be discharged while being caught by providing running carriage 33 of cloth spreading machine 21 with catching means. Since air is blown to the bottom surface of piled sheet material 24, the load of piled sheet material 24 onto spreading table 22 can be reduced and piled sheet material 24 can be automatically caught and easily discharged. Thus, discharging is automated and manual operation by two or more workers is eliminated.

Since piled sheet material 24 is carried onto cutting table 57 of automatic cutting machine 56, the steps of discharging and cutting the fabric can be continuously and automatically carried out. Piled sheet material 24 can be fed onto cutting table 57 of automatic cutting machine 56 in linkage to the movement of running carriage 33. The conveying function of cutting table 56 is utilized and the load required for delivering piled sheet material 24 on cloth spreading machine 21 side is reduced.

Since the steps of catching, blowing, delivering, and releasing piled sheet material 24 from being caught are repeated by the use of the repeating method system, soft fabrics that are easily loosened or folded or composed of a relatively small number of layers can be delivered in a satisfactory condition. Since piled sheet material 24 can be caught by the use of an underlay sheet, piled sheet material 24 can be delivered in a satisfactory condition. Piled sheet material 24 can be delivered onto cutting table 57 of automatic cutting machine 56 in a state of piled sheet material 24 such that the uppermost layer of piled sheet material 24 is covered with air-impermeable covering sheet 61. Thus, the step of covering with air-impermeable covering sheet 61 is carried out on cloth spreading machine 21 in advance, and as a result the number of operations conducted at automatic cutting machine 56 is reduced.

In addition, piled sheet material 24 is caught by the catching means, which is arranged in running carriage 33 and is allowed to travel and move with running carriage 33. Air blown from the surface of spreading table 22 by the air compressing means allows piled sheet material 24 to be easily delivered. Thus adding only the catching means to running carriage 33 enables automatic delivery of fabric by a simple construction. The catching means presses piled sheet material 24 from upside and catches at least a part of piled sheet material 24 between the catching means and spreading table 22 surface. Piled sheet material 24 can be satisfactorily caught and delivered by the pressing force and air pressure from cutting table 21.

The pressing means is provided in the front of running carriage 33 in the piled fabric delivering direction. Thus, a short fabric can be delivered by catching a front portion of piled sheet material 24. The pressing means presses the top layer of piled sheet material 24 from upside, which allows fabric having a large area to be easily caught. Since piled sheet material 24 is caught by pressing an underlay sheet having a width larger than that of piled sheet material 24, the pressing force is not exerted to the piled fabric.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for discharging a fabric from a cloth spreading machine having a discharge direction, wherein the fabric is delivered and piled in layers in a predetermined length onto a spreading table of the cloth spreading machine from a running carriage with a catching device, the running carriage loaded with a fabric roll, the method comprising:

moving the running carriage to a predetermined catching position in relation to the piled fabric;

operating the catching device of the running carriage to catch the piled fabric such that moving the running carriage will cause the piled fabric to move;

blowing air toward a bottom surface of the piled fabric from the spreading table to facilitate movement of the piled fabric; and discharging the piled fabric from the spreading table by running the running carriage in the discharge direction.

2. The discharging method of claim 1 wherein the step of discharging comprises discharging the piled fabric from the spreading table to a cutting table of an automatic cutting machine installed downstream of the discharge direction of the spreading table by running the running carriage.

3. The discharging method of claim 2 wherein wherein the step of discharging further comprises coordinating the movement of the running carriage with the movement of a conveyor of the cutting table.

4. The discharging method of claim 3 further comprising the steps of:

releasing the piled fabric from the catching device; and repeating the steps of catching, blowing, discharging, and releasing once for each of a second predetermined length of fabric.

5. The discharging method of claim 1 further comprising the steps of:

delivering the fabric from the running carriage piled in layers onto an underlay sheet pre-spread on the spreading table; and catching the piled fabric through the underlay sheet.

6. The discharging method of claim 1 further comprising the step of covering the piled fabric with an air-impermeable covering sheet.

7. An apparatus for delivering a predetermined length of fabric onto a spreading table, for piling the fabric in layers and for discharging the piled fabric from a cloth spreading machine in a discharge direction, the apparatus comprising:

a running carriage loaded with a fabric roll;

a catching device coupled to the running carriage, the catching device adapted to controllably catch and release the piled fabric;

an air compressor coupled to the spreading table for blowing air from the spreading table toward the piled fabric to facilitate movement of the piled fabric; and a controller coupled to the running carriage and the air compressor, the controller adapted to control the running carriage to run and move to a predetermined catching position so that the running carriage catches the piled fabric such that moving the running carriage will cause the piled fabric to move, the controller further operable to control the air compressor such that the running carriage runs and moves while the air compressor is operated.

8. The apparatus of claim 7 wherein the catching device comprises a pressing device for pressing the piled fabric towards the spreading table.

9. The apparatus of claim 8 wherein the pressing device is installed on a side of of the running carriage that is closest to the discharge direction.

10. The apparatus of claim 8 wherein the pressing device is a propelling means coupled to the running carriage in a manner so that the pressing device presses an uppermost layer of the piled fabric.

11. The apparatus of claim 8 wherein the piled fabric is loaded on an underlay sheet having a width larger than that of the piled fabric in relation to a conveying direction of the piled fabric and the pressing device is coupled to the running carriage in a manner so that the pressing device presses the underlay sheet in an area outside of the width of the region where the piled fabric is placed.

12. The apparatus of claim 7 wherein the running carriage further comprises a propelling means adapted to propel the piled fabric by pressing forward a rear end surface of the piled fabric in the discharge direction and the running carriage is in contact with the rear end surface of the piled fabric while it is propelled.

13. The apparatus of claim 7 wherein the controller is adapted to control the running speed of the running carriage as it discharges the piled fabric.

* * * * *